US008186019B2

(12) United States Patent
Peluso et al.

(10) Patent No.: US 8,186,019 B2
(45) **Date of Patent: *May 29, 2012**

(54) GRIPPING HANDLE FOR SUPPORTING A TOOL EXTENSION

(76) Inventors: Daniel A. Peluso, Centereach, NY (US); Anthony N. Fresco, Melville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/050,025

(22) Filed: Mar. 17, 2011

(65) Prior Publication Data

US 2011/0162168 A1 Jul. 7, 2011

Related U.S. Application Data

(63) Continuation of application No. 12/400,301, filed on Mar. 9, 2009, now Pat. No. 7,945,998, which is a continuation of application No. 11/195,114, filed on Aug. 2, 2005, now Pat. No. 7,513,015.

(51) Int. Cl.
*B25G 1/04* (2006.01)

(52) U.S. Cl. ..... 16/436; 16/421; 16/427

(58) Field of Classification Search ..... 16/421, 16/422, 436, 110.1; 81/177.4, 489, 177.1; 433/114, 126, 128, 129; 408/127, 110, 123, 408/124

See application file for complete search history.

(56) References Cited

U.S. PATENT DOCUMENTS

| | | | |
|---|---|---|---|
| 2,341,947 | A | 2/1944 | Roberts |
| 2,652,736 | A | 9/1953 | Kiene |
| 2,747,384 | A | 5/1956 | Beam |
| 2,906,144 | A | 9/1959 | McManis |
| 3,138,183 | A | 6/1964 | Stewart |
| 3,474,838 | A | 10/1969 | Schmitt |
| 3,973,784 | A | 8/1976 | Smith |
| 4,016,684 | A | 4/1977 | Urda |
| 4,265,148 | A | 5/1981 | Gartzke |
| 4,375,341 | A | 3/1983 | Schulze |
| 4,735,118 | A | 4/1988 | Broemel, Jr. |
| 4,827,809 | A | 5/1989 | Broemel, Jr. |
| 5,926,913 | A | 7/1999 | Hernandez et al. |
| 6,471,268 | B1 | 10/2002 | Stenstrom et al. |
| 2007/0028421 | A1 | 2/2007 | Peluso |

OTHER PUBLICATIONS

Snap-on.com, "Blue-Point, The Fastest Non-Powered Speed Handle", TURBOT103, Taiwan (2006).

*Primary Examiner* — Chuck Y. Mah
(74) *Attorney, Agent, or Firm* — Carter, DeLuca, Farrell & Schmidt, LLP

(57) ABSTRACT

A handle for a rotating tool extension is disclosed. The handle includes a body member having a central portion with first and second end portions. The body member is positionable along an axis of rotation of the rotating tool extension and includes a bore formed in the body member extending therethrough along the axis of rotation. A liner may be at least partially disposed within the bore, and may be at least partially removable from and insertable within the bore. A rotating tool extension is at least partially inserted within the liner. Alternatively, the body member may include at least one roller bearing member contacting at least a portion of the rotating tool extension during rotation of the extension. The handle and extension may be provided as a combination and also as a kit.

17 Claims, 3 Drawing Sheets

GRIPPING HANDLE FOR SUPPORTING A TOOL EXTENSION

PRIORITY

This application is a continuation application of an application filed on Mar. 9, 2009 titled "GRIPPING HANDLE FOR SUPPORTING A TOOL EXTENSION" and assigned U.S. application Ser. No. 12/400,301 which is a continuation application of an application filed on Aug. 2, 2005 titled "GRIPPING HANDLE FOR SUPPORTING A ROTATING TOOL EXTENSION" and assigned U.S. application Ser. No. 11/195,114. The latter application issued as U.S. Pat. No. 7,513,015 on Apr. 7, 2009. The entire contents of the applications and the patent are incorporated herein by reference.

BACKGROUND OF THE INVENTION

1. Field of the Invention

The present invention relates generally to rotating tools, and more particularly, to an extension for use with rotating tools such as pneumatically powered tools.

2. Description of Related Art

Rotating tools such as pneumatically powered, or air powered, tools are well known. Pneumatic tools provide a facile means of applying a torque force to a fastener, such as a bolt or nut, for enabling an operator of such a tool to secure the fastener. Thus, pneumatic tools are capable of applying a substantial torque force to a desired fastener, while the operator typically only steadies or braces the tool against the torque force. Therefore, these tools have found wide acceptance in a number of different mechanically based trades, such as the automotive repair industry.

Pneumatic tools typically comprise a body portion that includes a handle, and a head portion that includes drive means for retaining a socket or other similar fastener driving member. A switch for activating and deactivating a pneumatic source coupled to the tool is usually positioned along the handle of the tool. However, pneumatic tools are relatively larger than their manually controlled counterparts, due to their incorporation of pneumatic control componentry.

Pneumatic tools are particularly useful when repairing automobiles, since they are well suited for applying torque to fasteners located in small workspaces, that do not allow a sufficient range-of-motion for an operator to manually tighten the fastener. However, these small workspaces are often elongated and relatively inaccessible to even pneumatic tools, since there is not sufficient room for an operator of the tool to place his or her hand, and potentially arm, in the confined workspace and along with the tool, for controlling activation of the tool.

As a result of the foregoing and other reasons, oftentimes it is necessary for a rotating extension to be placed between the fastener fittings and the pneumatic tool so as to not only provide greater flexibility but also to provide greater torque due to the torsional deflection of the extension.

To control the rotating extension, users often rely on grasping the rotating extension.

What is needed is a handle for a rotating extension which facilitates control of the rotating extension while not requiring the user to grasp the extension.

SUMMARY

It is an object of the present disclosure to provide a handle for a rotating tool extension which facilitates control of the rotating extension while not requiring the user to grasp the extension.

It is an object of the present disclosure to provide a combination handle and rotating tool extension which facilitates control of the rotating extension while not requiring the user to grasp the extension.

It is an object of the present invention to provide a kit including a combination handle and rotating tool extension which facilitates control of the rotating extension while not requiring the user to grasp the extension.

The present disclosure relates to a handle for a rotating tool extension. The handle includes a body member having a central portion with first and second end portions, with the body member being positionable along an axis of rotation of the rotating tool extension; and a bore formed in the body member extending therethrough along the axis of rotation. A liner may be at least partially disposed within the bore, and the liner may be at least partially removable and insertable within the bore.

In one embodiment, at least one of the first and second end portions is configured to at least partially limit movement of a hand of a user of the handle. A rotating tool extension may be at least partially inserted within the bore. In one embodiment, a rotating tool extension is at least partially inserted within the liner. A motion limiting member may be disposed on one of the handle and the rotating tool extension to limit motion of the handle with respect to the axis of rotation. In one embodiment, the body member further includes at least one roller bearing member contacting at least a portion of the rotating tool extension during rotation of the extension.

The present disclosure relates also to a combination rotating tool extension and handle including: a handle, with the handle including a body member having a central portion with first and second end portions, the body member being positionable along an axis of rotation of the rotating tool extension; a bore formed in the body member extending therethrough along the axis of rotation; and a rotating tool extension at least partially disposed within the bore.

Additionally, the present disclosure relates to a kit including: a handle for a rotating tool extension, the handle having: a body member having a central portion with first and second end portions, the body member being positionable along an axis of rotation of the rotating tool extension; and a bore formed in the body member extending therethrough along the axis of rotation; and a rotating tool extension for at least partial insertion within the bore.

In one embodiment, the kit may further include a liner for at least partial insertion within the bore. In one embodiment, the body member may further include at least one roller bearing member for contacting the rotating tool extension during rotation of the extension. Alternatively, the rotating tool extension may further include at least one roller bearing member contacting the handle during rotation of the extension. Still further, the rotating tool extension may further include at least one roller bearing member contacting the liner during rotation of the extension.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

The present disclosure will be understood more fully from the detailed description given below and from the accompanying drawings of particular embodiments of the invention which, however, should not be taken to limit the invention to a specific embodiment but are for explanatory purposes.

Numerous specific details may be set forth herein to provide a thorough understanding of a number of possible embodiments of a combination handle and rotating tool extension incorporating the present disclosure. It will be understood by those skilled in the art, however, that the embodiments may be practiced without these specific details. In other instances, well-known methods, procedures, components and circuits have not been described in detail so as not to obscure the embodiments. It can be appreciated that the specific structural and functional details disclosed herein may be representative and do not necessarily limit the scope of the embodiments.

Some embodiments may be described using the expression "coupled" and "connected" along with their derivatives. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments disclosed herein are not necessarily limited in this context.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
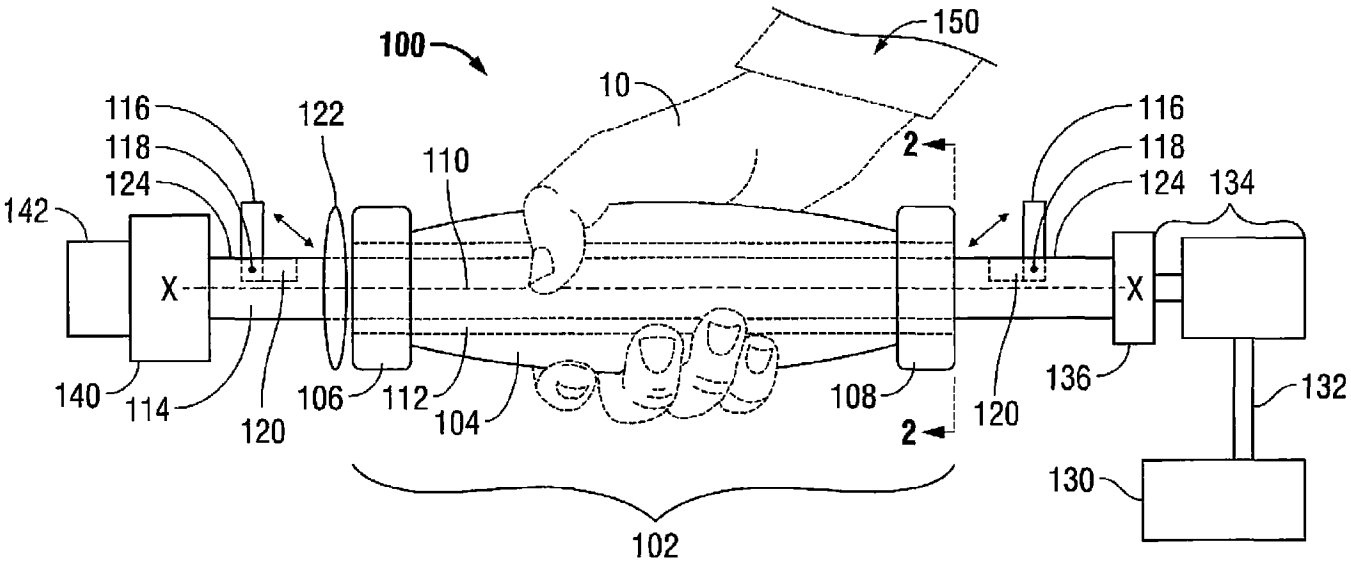
FIG. 1 shows a partially schematic view of one embodiment of a handle and rotating tool extension according to the present disclosure.
Figure 2:
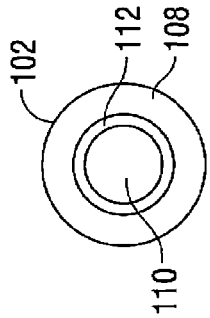
FIG. 2 shows an end cross-sectional view of the handle and rotating tool extension taken along section line 2-2 of FIG. 1.

Turning now to the details of the present disclosure, FIGS. 1 and 2 illustrate one embodiment of a handle 100 for a rotating tool extension 114. More particularly, the handle 100 includes a body member 102 having a central portion 104 with first and second end portions 106 and 108, respectively. The body member 102 is elongated and positionable along, or extends along, an axis of rotation X-X of the rotating tool extension 114. A passage or bore 110 is formed in the body member 102 and extends therethrough along the axis of rotation X-X and through the first and second end portions 106 and 108. The body member 102 typically is made from a metal or plastic material or a combination thereof.

In one embodiment, a bushing or liner 112 is at least partially disposed within the bore 110. The liner 112 is at least partially removable and insertable within the bore 110 and is typically inserted completely within the bore 110. The liner 112 is made from heat resistant materials, for example and not limited to, Teflon® and hard plastics. Typically, rotating tool extension 114 is at least partially inserted within the bore 110, and typically is inserted entirely within the bore 110, during operation of a rotating tool 134. The rotating tool 134 is coupled to the rotating tool extension 114 via a coupling 136. The rotating tool 134 may be supplied power via several different ways, such as, for example and not limited to, pneumatically, hydraulically, or electrically. In one embodiment, an air supply 130 supplies air to the rotating tool 134 via a hose 132.

At least one of the first and second end portions 106, 108 is configured to at least partially limit movement of a hand 10 of a user of the handle 100. Typically, the limiting of movement of the hand 10 is accomplished via the first or second end portion 106, 108 having an outer diameter which is greater than an outer diameter of the central portion 104 proximate to the end portions 106, 108. In addition, body member 102 may be made from or coated with a material such as, but not limited to, an epoxy material in a shape configured to facilitate gripping. More particularly, the central portion 104 may be ergonomically designed with contours (not shown) to accommodate the fingers of the hand 10.

In addition, both fine control and gross control motion limiting members may be disposed on the rotating tool extension 114. More particularly, gross control motion limiting members 116, for example but not limited to, in the form of "flip-top" panels pivotable around hinges 118 into cavities 120 formed within a portion of the outer surface 124 of extension 114 may be disposed thereon to limit motion of the handle 102 along the axis of rotation X-X. A fine control motion limiting member 122, for example but not limited to, in the form of an expandable O-ring may also be disposed on the outer surface 124 of the rotating tool extension 114 to limit motion of the handle 100 with respect to the axis of rotation X-X. The motion of handle 100 which is limited may be at least one of longitudinal and lateral motion with respect to the axis of rotation X-X. The lateral motion is substantially limited so as to minimize vibrations or "rattling" of the extension 114 against the handle 100. The O-ring may be made from, for example and not limited to, rubber, metals and plastics. Alternatively, the fine control motion limiting member 122 may also be configured to be disposed on, or extend from, or be incorporated into, at least a portion of the body member 102, and in particular, into one of the first and second end portions 106 and 108.

Figure 3:
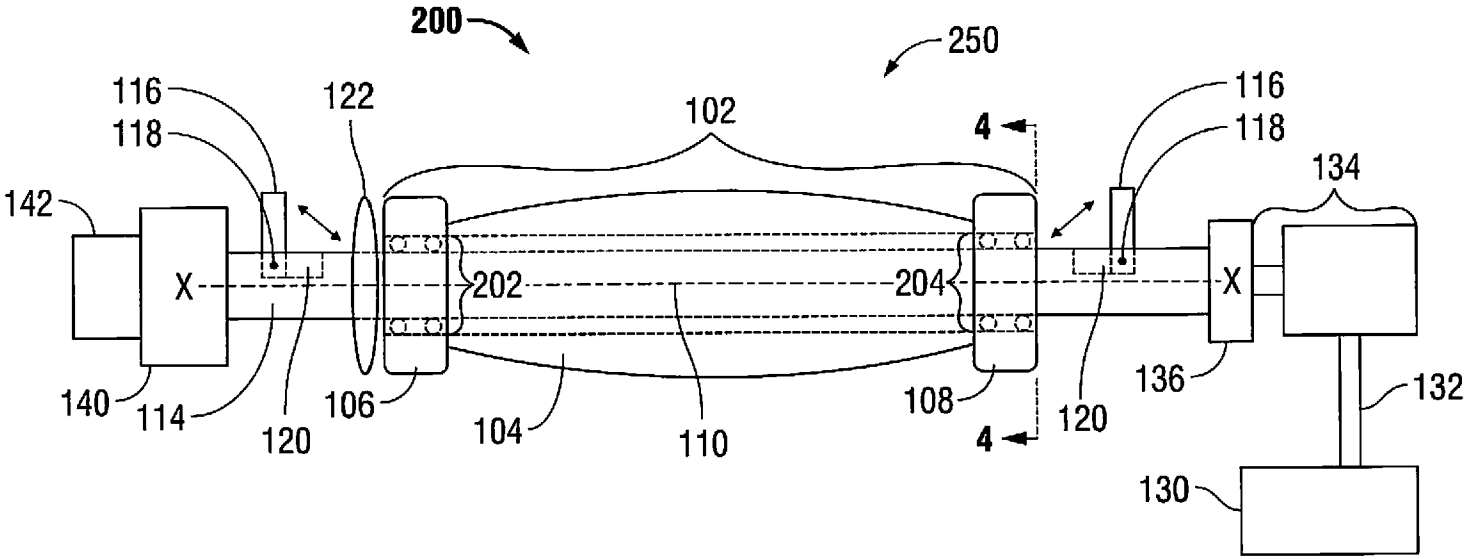
FIG. 3 shows a partially schematic view of another embodiment of the handle and rotating tool extension according to the present disclosure.
Figure 4:
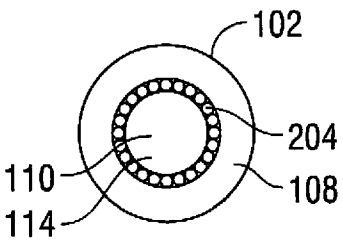
FIG. 4 shows an end cross-sectional view of the handle and rotating tool extension taken along section line 4-4 of FIG. 3.

FIGS. 3 and 4 show one embodiment of the present disclosure. More particularly, handle 200 is identical to handle 100 except that in place of liner or bushing 112, the body member 104 further includes at least one roller bearing member 202 or 204 for contacting at least a portion of the rotating tool extension 114 during rotation of the extension 114. The user's hand 10 is not shown for simplicity but those skilled in the art will recognize that the hand 10 may be applied to handle 200 in the same manner as if being applied to handle 100.

As illustrated in FIGS. 3 and 4, the roller bearing member 204 is disposed within second end portion 108 around the extension 114. The roller bearing member may be, for example but not limited to, a ball bearing as shown, or a sleeve bearing. Alternatively, other bearing designs may be applied such as contactless magnetic bearings. In addition, the roller bearing member 202 or 204 may be disposed within the extension 114 rather than in the body member 102 such that at least one roller bearing member 202 or 204 contacts the handle 200 during rotation of the extension 114. The bearing members 202 and 204 restrain displacement of the extension 114 in a direction transverse to the axis of rotation X-X. The embodiments are not limited in this context. Those skilled in the art will recognize that handle 200 is otherwise installed and operated in the same manner as handle 100.

Figure 5:
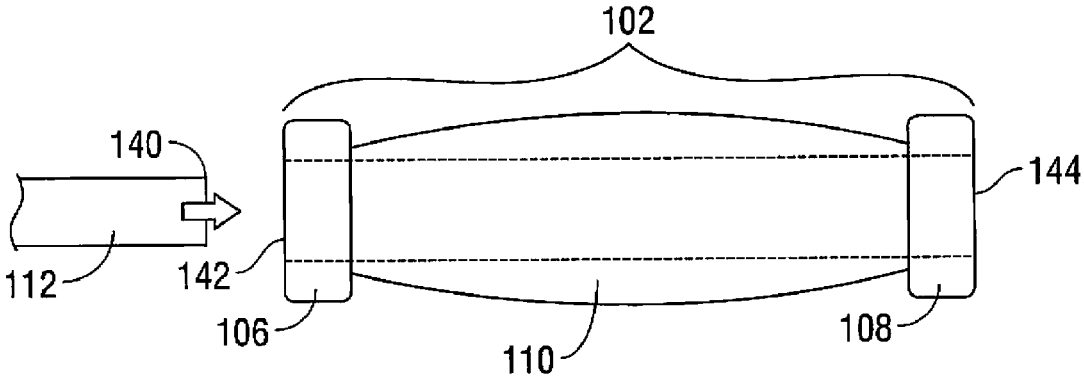
FIG. 5 shows a liner being inserted into the handle of FIG. 1.

FIG. 5 illustrates a method of inserting the liner or bushing 112 into the body member 102 of handle 100 illustrated in FIGS. 1 and 2. More particularly, an end 140 of the liner 112 is inserted into an aperture 142 formed by the bore 110 at the first end portion 106. The liner 112 is inserted through the bore 110 in the body member 112 and through an aperture 144 formed by the bore 110 at the second end portion 108. Those skilled in the art will recognize that the procedure may be reversed for withdrawing the liner 112 from the bore 110. In addition, those skilled in the art will recognize that the end 140 of the liner 112 may also be first inserted through the bore 110 at aperture 144 and inserted through body member 110 and through aperture 142.

Referring again to FIGS. 1 and 2, another embodiment of the present disclosure is disclosed in the form of a combination rotating tool extension and handle 150. More particularly, the combination rotating tool extension and handle 150 includes the handle 100 and the extension 114 at least partially inserted through the bore 110. The combination 150 may further include the liner 112 at least partially inserted through the bore 110 with the extension 114 at least partially inserted through the liner 112.

Those skilled in the art will recognize that all of the other features and limitations of handle 100 and extension 114 previously described with respect to FIGS. 1 and 2 are again applicable to the combination 150. The combination rotating tool extension and handle 150 and liner 112 may further be provided in the form of a kit enabling ready assembly and use by a user.

Similarly, again referring to FIGS. 3 and 4, another embodiment of the present disclosure is disclosed in the form of a combination rotating tool extension and handle 250. More particularly, the combination rotating tool extension and handle 250 includes the handle 200 and the extension 114 at least partially inserted through the bore 110 such that at least one roller bearing member 202 or 204 contacts the extension 114 during rotation of the extension 114.

Those skilled in the art will recognize that all of the other features and limitations of handle 200 and extension 114 previously described with respect to FIGS. 3 and 4 are again applicable to the combination 250. The combination rotating tool extension and handle 250 may further be provided in the form of a kit enabling ready assembly and use by a user.

In addition, the handles 100 and 200 may be configured such that both the liner 112 and roller bearing members 202 and 204 may be combined into one handle such as 200. In addition, the bearing members 202 and 204 may be disposed on or within the extension 114 so as to contact the liner 112 or the handle 100 or 200 such as at the surface of the bore 110.

In conclusion, the foregoing embodiments of the present disclosure provide a handle for a rotating tool extension which facilitates control of the rotating extension while not requiring the user to grasp the extension. In addition, the foregoing embodiments provide a combination handle and rotating tool extension which facilitates control of the rotating extension while again not requiring the user to grasp the extension and also provide a kit including a combination handle and rotating tool extension which facilitates control of the rotating extension while still yet again not requiring the user to grasp the extension.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of preferred embodiments. Those skilled in the art will envision other modifications within the scope and spirit of the claims appended hereto.

What is claimed is:

1. A handle for a tool extension, the handle comprising:

a body member having a central portion between first and second end portions of the body member, the body member positionable along an axis of rotation of the tool extension; and a bore formed in the body member extending therethrough along the axis of rotation, wherein the tool extension is configured and dimensioned for being at least partially disposed within the bore;

wherein the handle is configured for being in combination with the tool extension and for contacting a member positioned on the tool extension; and at least one roller bearing member positioned within the bore, wherein the at least one roller bearing member includes a central opening for passage of the tool extension therethrough.

2. The handle for a tool extension according to claim 1, wherein the at least one roller bearing member is selected from the group consisting of a ball bearing member, a sleeve bearing member and a magnetic bearing member.

3. The handle for a tool extension according to claim 1, further comprising a liner disposed within the bore and having a central opening for passage of the tool extension therethrough.

4. The handle for a tool extension according to claim 1, wherein the at least one roller bearing member is positioned within at least one of the end portions of the body member.

5. A combination tool extension and handle comprising:

a handle, the handle including a body member having a central portion between first and second end portions of the body member, the body member positionable along an axis of rotation of the tool extension;

a bore formed in the body member extending therethrough along the axis of rotation;

at least one roller bearing member configured for placement within the bore; and a tool extension at least partially disposed within the bore; and a member positioned on the tool extension and configured for contacting the handle.

6. The combination tool extension and handle according to claim 5, wherein the at least one roller bearing member includes a central opening for passage of the tool extension therethrough.

7. The combination tool extension and handle according to claim 5, wherein the at least one roller bearing member is selected from the group consisting of a ball bearing member, a sleeve bearing member and a magnetic bearing member.

8. The combination tool extension and handle according to claim 5, wherein the member positioned on the tool extension is an O-ring.

9. The combination tool extension and handle according to claim 5, further comprising a liner disposed within the bore and having a central opening for passage of the tool extension therethrough.

10. The combination tool extension and handle according to claim 5, wherein the tool extension is fully disposed within the bore.

11. The combination tool extension and handle according to claim 5, wherein the at least one roller bearing member is positioned within at least one of the end portions of the body member.

12. The combination tool extension and handle according to claim 5, wherein the at least one roller bearing member is positioned on the tool extension and configured to contact an inner surface of the bore when the tool extension is disposed within the bore.

13. A method for using a tool extension, the method comprising:

providing a handle comprising:

a body member having a central portion between first and second end portions of the body member, the body member positionable along an axis of rotation of the tool extension;

a bore formed in the body member extending therethrough along the axis of rotation; and at least one roller bearing member positioned within the bore;

at least partially disposing the tool extension within the bore; and rotating the tool extension while holding the handle.

14. The method according to claim 13, wherein the at least one roller bearing member is selected from the group consisting of a ball bearing member, a sleeve bearing member and a magnetic bearing member.

15. The method according to claim 13, further comprising positioned on the tool extension an O-ring.

16. The method according to claim 13, further comprising disposing a liner within the bore.

17. The method according to claim 13, wherein the at least one roller bearing member is positioned within at least one of the end portions of the body member.

* * * * *